US005365760A

United States Patent [19]

Song

[11] Patent Number: 5,365,760

[45] Date of Patent: Nov. 22, 1994

[54] KEY SECURITY DEVICE

[76] Inventor: Chang J. Song, 6740 Comstock Road, Richmond, British Columbia, Canada

[21] Appl. No.: 198,676

[22] Filed: Feb. 18, 1994

Related U.S. Application Data

[63] Continuation of Ser. No. 990,614, Dec. 14, 1992, abandoned.

[51] Int. Cl.[5] ..... E05B 19/24

[52] U.S. Cl. ..... 70/460; 70/456 R; 40/330

[58] Field of Search ..... 70/408, 456 R–458, 70/460; 24/3 K, 3 L, 458; 40/330, 634

[56] References Cited

U.S. PATENT DOCUMENTS

| | | | |
|---|---|---|---|
| 1,425,089 | 8/1922 | Henry . | |
| 1,462,193 | 7/1923 | Cook . | |
| 1,473,361 | 11/1923 | Tebbetts . | |
| 1,837,114 | 12/1931 | Cicourel | 40/330 X |
| 1,886,110 | 11/1932 | Lippstadt . | |
| 2,071,021 | 11/1937 | Brandt | 24/3 |
| 2,231,308 | 2/1941 | Walsh et al. | 24/3 K |
| 2,432,498 | 12/1947 | Bloomfield | 40/2 |
| 2,600,563 | 6/1952 | Michnoff | 24/3 |
| 2,894,302 | 7/1959 | Fox | 24/73 |
| 2,988,836 | 6/1961 | Oberfield | 40/330 |
| 3,173,280 | 3/1965 | Oberacker | 70/456 R |
| 3,225,478 | 12/1965 | Rohmer | 40/330 |
| 3,267,534 | 8/1966 | Dansereau | 70/456 R X |
| 3,729,965 | 5/1973 | Gartner | 70/408 X |
| 3,955,725 | 5/1976 | Rese | 70/460 X |
| 4,562,712 | 1/1986 | Wolter | 70/456 R |
| 4,768,362 | 9/1988 | Schmalz, Jr. | 70/456 R X |
| 5,038,590 | 8/1991 | Sawyer et al. | 70/458 |
| 5,113,602 | 5/1992 | Levine et al. | 40/330 X |

FOREIGN PATENT DOCUMENTS

| | | | |
|---|---|---|---|
| 205878 | 10/1959 | Austria | 70/457 |
| 2031266A | 4/1980 | United Kingdom . | |
| 2243986 | 11/1991 | United Kingdom | 70/456 R |
| 9005821 | 5/1990 | WIPO | 70/456 R |

*Primary Examiner*—Peter M. Cuomo
*Assistant Examiner*—Suzanne L. Dino
*Attorney, Agent, or Firm*—Townsend and Townsend

[57] ABSTRACT

A key and clip combination useful for securing a spare key in a wallet or purse and for key identification. The clip is low profile and prevents the wallet or purse from becoming bulky. The clip may also include apertures for exposing the hole within the key used for placing the key on a key chain or key peg.

7 Claims, 2 Drawing Sheets

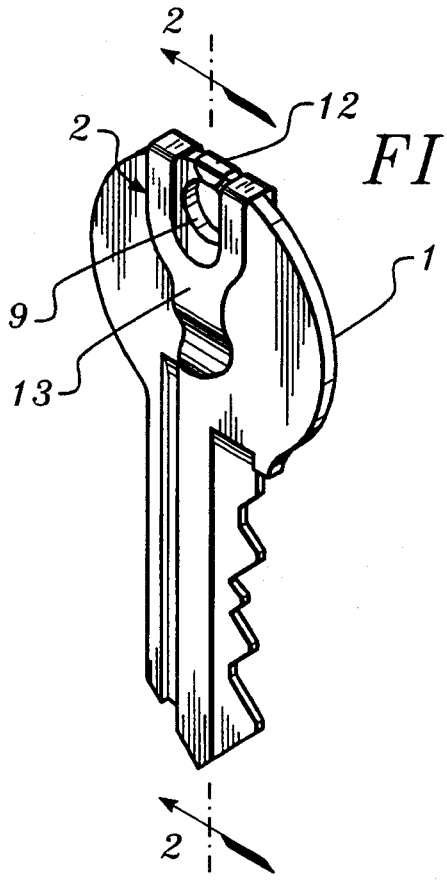
FIG. 1A.
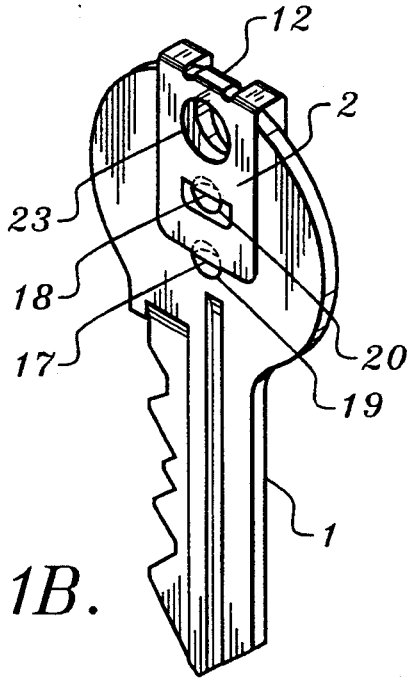
FIG. 1B.
FIG. 1C.
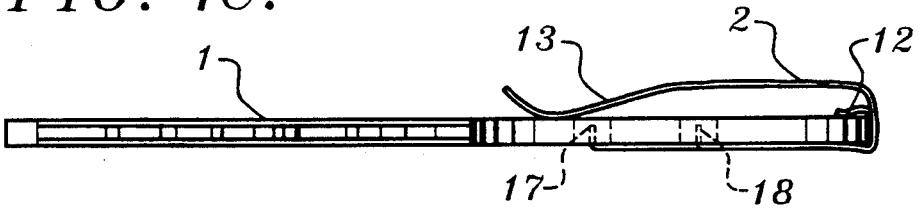
FIG. 2.
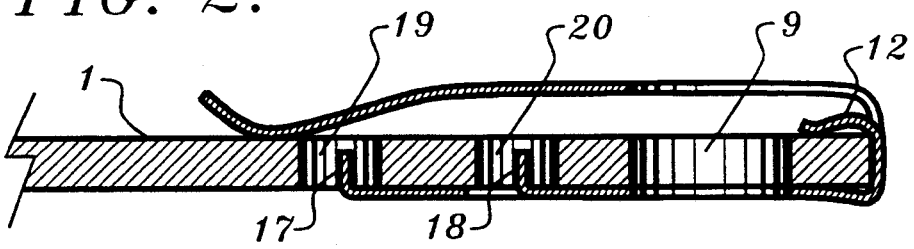

KEY SECURITY DEVICE

This is a continuation of application Ser. No. 07/990,614 filed Dec. 14, 1992, now abandoned.

BACKGROUND OF THE INVENTION

The present invention relates to keys and more particularly to devices for preventing key loss and for quick key identification.

People frequently lock themselves out of their cars, homes, apartments and other secured devices or areas. Many who have experienced loss of a key or wish to prevent this unpleasant event carry a spare key in their wallet or purse. These spare keys, however, tend to slip out and become easily lost unbeknownst to the owner.

In addition to perpetuating the undesirable condition of being locked out, a lost spare key may present other hazards. The lost spare key may be found and used by an unauthorized person for illegal purposes. Furthermore, during the time spent searching for the lost spare key, the individual is vulnerable to attack both because they are distracted and because they are denied access to a more secure area.

SUMMARY OF THE INVENTION

The present invention provides a key and key securing device that enables the key to be easily and securely placed in a wallet or purse and can be used to facilitate quick identification of one specific key among many.

According to one embodiment of the present invention, a clip fits over a top portion of the key and allows the key to be securely attached inside a wallet or purse. The clip includes at least one leg for engaging an aperture in the key to secure the clip to the key and prevent the clip from swiveling. Thus, the present invention prevents the key from detaching from the clip or clamped object and becoming lost.

The clip also includes an opening for exposing a hole commonly contained within the key for receiving a key ring or key peg. In this manner, the present invention does not limit the key to a single secure location and the key may also be placed on a key ring or key fob. The clip may also be used as a visual and/or tactile signaling mechanism to readily identify a particular key on the ring or fob.

According to another embodiment of the present invention, the clip device is formed of a single piece of metal and requires no hardware to secure it to the key. This feature reduces the complexity of the present invention and eliminates the need for special tools to use or disengage the invention. The construction of the present invention also provides a slim profile to reduce wallet bulk and minimize undue wear on the wallet.

BRIEF DESCRIPTION OF THE DRAWINGS

FIG. 1A is a front view of a key and clip according to an embodiment of the present invention;

FIG. 1B is a rear view of the key and clip of FIG. 1A;

FIG. 1C is a side view of the key and clip of FIG. 1A;

FIG. 2 is a cross section of the key and clip of FIG. 1A according to an embodiment of the present invention;

DESCRIPTION OF THE PREFERRED EMBODIMENT

Figure 3:
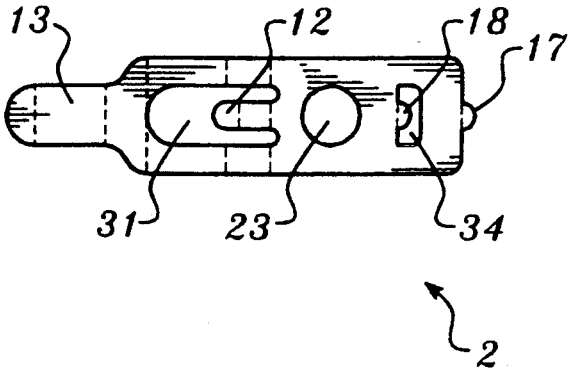
FIG. 3 is a an open view of a key clip according to an embodiment of the present invention.

FIG. 1A is a front view of a key 1 and key securing device, or clip 2, according to an embodiment of the present invention. Key 1 is provided with a hole 9 useful for securing key 1 to a key ring or for placing key 1 on a key peg or key fob. Clip 2 includes an aperture and fits over key 1 as shown so as not to obscure hole 9 of key 1. When key 1 is placed on a key ring or key peg, clip 2 also functions as a means of quickly recognize the key. For example, a woman approaching a car in a darkened garage can quickly reach into a dark purse and grab the appropriate key by feeling for the key with clip 2 attached. In this manner, clip 2 provides a tactile means of quickly recognizing the appropriate car key and reduces the woman's chances of becoming a crime victim.

Also shown in FIG. 1A is a spring 12 of clip 2. Spring 12 grips key 1 and aids in securing clip 2 to the key. The resilient nature of spring 12 allows clip 2 to attach securely to keys of varying thickness. Clip 2 also includes a tongue 13. Tongue 13 slips over the inner partitions of a wallet, for example, to secure key 1 within the wallet. Optionally, tongue 13 may be used to secure key 1 within a purse or a shirt pocket. Like spring 12, the resilient nature of tongue 13 enables clip 2 to secure key 1 to surfaces of varying thickness.

FIG. 1B is a rear view of the key and clip assembly of FIG. 1A. In FIG 1B may be seen legs 17 and 18 of clip 2. Legs 17 and 18 fit into holes 19 and 20 cut into key 1 and serve to firmly anchor clip 2 to key 1 and to prevent clip 2 from swiveling. If clip 2 were allowed to swivel, key 1 could easily detach from the wallet or other device to which it is secured. Furthermore, key 1 could itself become separated from clip 2. Also seen in FIG. 1B is a circular aperture 23 of clip 2 that exposes hole 9 of key 1 and enables key 1 to be placed on a key ring or key peg.

FIG. 1C is a side view of the key and clip assembly described in FIGS. 1A and 1B wherein spring 12, tongue 13, and legs 17 and 18 may be seen. FIG. 1C also illustrates how clip 2 fits over key 1 with a low profile. The low profile of clip 2 means that bulk is not added to the wallet or purse when the key/clip combination of the present invention is used.

Other methods of securing a key in a wallet rely on forming the key into bulky plastic cards or include other bulky attachment mechanisms that unnaturally expand the wallet, purse or pocket. The additional bulk added by these devices distorts the shape of the wallet, purse or pocket resulting in an unsightly appearance and accelerating the wear of these objects.

In contrast, the low profile of the present invention does not cause unsightly bulges or add unnecessary bulk to object to which the key is secured. Thus, the neatness and functionality of the object is maintained and the present invention does not accelerate wear of the object.

FIG. 2 is a cross section of the key of FIG. 1A taken at section 2—2. FIG. 2 illustrates the location of holes 19 and 20 of key 1 that receive legs 17 and 18 of clip 2. Also seen in FIG. 2 are the apertures located in clip 2 (not referenced) that expose hole 9 of key 1.

FIG. 3 describes the construction of clip 2 in greater detail. Clip 2 may be formed of a single flat piece of shaped metal which into which the desired apertures are cut prior to folding the metal to form clip 2. In FIG. 3, apertures 23 and 31 match hole 9 of key 1 as described above. Aperture 34 is provided for manufacturing convenience and facilitates bending of leg 18 into the desired orientation. The flat metal piece is folded at the locations of the dotted lines indicated in FIG. 3 to form spring 12, tongue 13, and legs 17 and 18 as well as to fold the clip into a shape that fits over key 1.

Figure 4A:
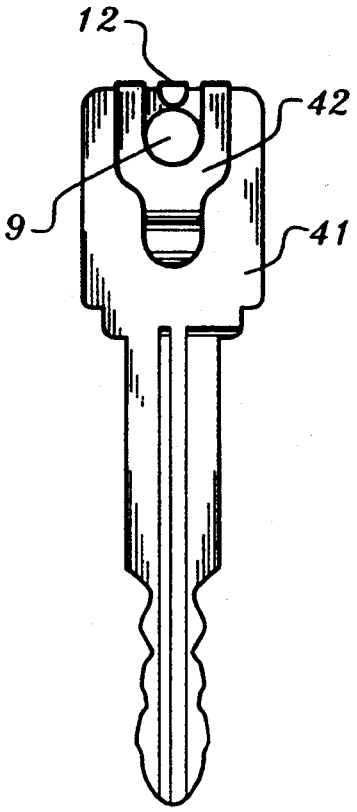
FIG. 4A is a front view of key and clip according to an alternate embodiment of the present invention.
Figure 4B:
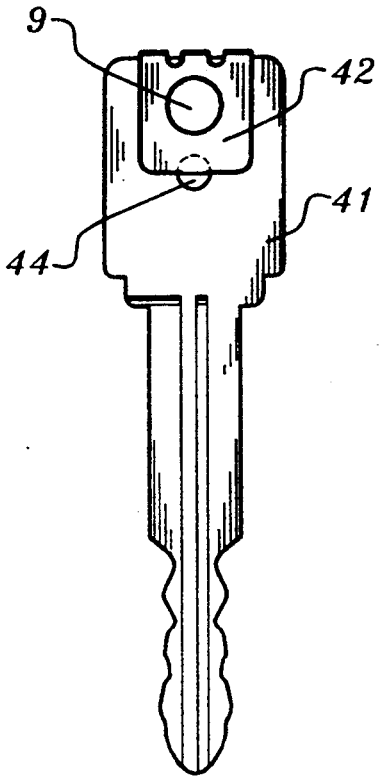
FIG. 4B is a rear view of the key and clip of FIG. 4A.

FIGS. 4A and 4B show an alternate embodiment of the invention useful with a straight ended key 41. FIG. 4A shows a front view of the key/clip combination, while FIG. 4B shows a rear view of the device of FIG. 4A. Clip 42 is constructed in a similar fashion to clip 2 described in the previous Figs. and includes a spring 12 for gripping key 41 as well as apertures for exposing hole 9 of key 41. With a straight ended key, however, clip 42 is less likely to swivel than is a clip placed over a round ended key. For this reason, key 41 may be constructed with a single aperture for receiving the single leg 44 of clip 42. Optionally, the key/clip combination for the straight ended key may include additional legs and apertures as desired.

Preferred embodiments of the invention have now been described. Variations and modifications will be readily apparent to those of skill in the art. For this reason, the invention is to be construed in light of the claims.

What is claimed is:

1. A security and identifying apparatus comprising:

a key having a first aperture for receiving at least one of a key ring or key peg and having a second aperture;

a clip, folded over a top portion of said key and having an opening adjacent said first aperture, wherein said opening exposes said first aperture; and said clip further including a leg for engaging said second aperture.

2. The apparatus of claim 1 wherein said key is a round ended key and said second aperture comprises at least two apertures.

3. The apparatus of claim 1 wherein said clip is formed of a single flat piece of metal.

4. The apparatus of claim 1 wherein said clip further comprises a spring for gripping said top portion of said key.

5. An apparatus for securing a key to an object comprising:

a single piece of material folded to form a clip wherein said clip fits over a top portion of the key and wherein said clip includes;

a tongue located on a lower portion of said clip for engaging said object; and a leg for securing said clip to the key; and wherein an upper interior end portion of said clip is adapted to contact with a top end portion of the key.

6. The apparatus of claim 5 wherein said clip further comprises a spring for gripping the key.

7. An apparatus for securing a key to an object comprising:

a piece of material folded to form a clip wherein said clip fits over a top portion of the key and wherein said clip includes;

a tongue located on a front portion of said clip for engaging said object; and a leg for securing said clip to the key; and wherein said clip has an aperture for exposing a hole contained in the key and wherein an upper interior end portion of said clip is adapted to contact with a top end portion of the key.

* * * * *